United States Patent [19]

Nakanishi et al.

[11] Patent Number: 4,915,800

[45] Date of Patent: Apr. 10, 1990

[54] PROCESS FOR ELECTROLYTICALLY SURFACE-ROUGHENING ALUMINUM SUPPORT

[75] Inventors: Haruo Nakanishi; Hirokazu Sakaki, both of Shizuoka, Japan

[73] Assignee: Fuji Photo Film Co., Ltd., Minami-ashigara, Japan

[21] Appl. No.: 284,661

[22] Filed: Dec. 15, 1988

[30] Foreign Application Priority Data

Dec. 18, 1987 [JP] Japan ..... 62-320893

[51] Int. Cl.[4] ..... C25D 13/18; C25D 13/20; C25F 3/00

[52] U.S. Cl. ..... 204/35.1; 204/37.6; 204/129.4; 204/129.75; 204/131

[58] Field of Search ..... 204/35.1, 129.75, 129.4, 204/129.43, DIG. 9, 131, 37.6

[56] References Cited

U.S. PATENT DOCUMENTS

| | | | |
|---|---|---|---|
| 3,891,516 | 6/1975 | Chu | 204/37.6 X |
| 4,547,274 | 10/1985 | Ohashi et al. | 204/129.4 |
| 4,561,944 | 12/1985 | Sasaki et al. | 204/129.4 X |
| 4,624,752 | 11/1986 | Arrowsmith et al. | 204/37.6 |
| 4,686,021 | 8/1987 | Nakanishi et al. | 204/DIG. 9 |

*Primary Examiner*—Donald R. Valentine

*Attorney, Agent, or Firm*—Burns, Doane, Swecker & Mathis

[57] ABSTRACT

The present invention relates to a process for electrically surface-roughening an aluminum support comprising forming an organic or inorganic coating on the aluminum support before the electrolytic surface-roughening of the aluminum plate. According to the present invention, a lithographic printing plate whose non-image area is difficult to be stained and which has an excellent printing durability is obtained.

9 Claims, 1 Drawing Sheet

PROCESS FOR ELECTROLYTICALLY SURFACE-ROUGHENING ALUMINUM SUPPORT

FIELD OF THE INVENTION

The present invention relates to a process for electrolytically surface-roughening an aluminum support used for a lithographic plate. Specifically, the present invention relates to an electrolytic surface-roughening process for preparing a lithographic aluminum support having a grained surface having uniform and deep pits by forming a thin layer resistant to the electrolytic roughening treatment on the surface of the aluminum plate prior to the electrolytic surface-roughening treatment.

BACKGROUND OF THE INVENTION

Aluminum plates have been widely used as a support for lithographic plate. The aluminum support is generally grained, that is, the surface of the support is roughened in order to improve the adhesion between the support and the photosensitive layer and also to impart water-retaining property to a non-image area.

The graining is conducted by a mechanical process such as the sandblasting process; the ball graining process; the wire graining process; the brush graining process with both a nylon brush and an abrasive/water slurry; a process wherein an aqueous abrasive slurry is sprayed onto the surface under high pressure; or a chemical graining process wherein the surface is roughened with an etching agent comprising an alkali, an acid or a mixture thereof. Further, various processes are known such as the electrochemical graining process described in Japanese Patent Unexamined Published Application (hereinafter referred to as "J. P. KOKAI") No.54-146234 and Japanese Patent Publication for Opposition Purpose (hereinafter referred to as "J. P. KOKOKU") No.48-28123; the process combining the mechanical graining process with the electrochemical graining process, as described in, for example, J.P. KOKAI No.53-123204; and the process combining the mechanical graining process with the chemical graining process which uses a saturated aqueous solution of an aluminum salt of a mineral acid, as described in J.P. KOKAI No.56-55291.

Among these surface-roughening processes, the electrolytic surface-roughening process is desirable, since the shape of the roughened surface can be easily controlled and the roughed surface can be fine.

When the adhesion between the support and the photosensitive layer is to be improved to obtain a printing plate capable of providing a large number of prints (hereinafter referred to as "printing durability" in the electrolytic surface-roughening process, deep graining must be conducted with a quantity of electricity of at least several hundred Coulombs. However, in such a case, the non-image area is stained, because pits of 10 $\mu$ or larger are formed by the electrolytic surface-roughening treatment.

On the other hand, when small pits of smaller than 10 $\mu$ are uniformly formed on the surface with a relatively small quantity of electricity, the printing durability is reduced, even though the non-image area is not easily stained in the printing step.

SUMMARY OF THE INVENTION

The object of the present invention is to provide an electrolytic surface-roughening process to prepare a lithographic aluminum support whose non-image area is difficult to be stained and which has a high printing durability.

The inventors have made intensive investigations for the purpose of accomplishing this object and have found that the present object can be attained by forming a thin layer resistant to the electrolytic surface-roughening treatment on an aluminum plate prior to this surface-roughening treatment. The present invention has been completed on the basis of this finding.

DETAILED DESCRIPTION OF THE INVENTION

Figure 1:
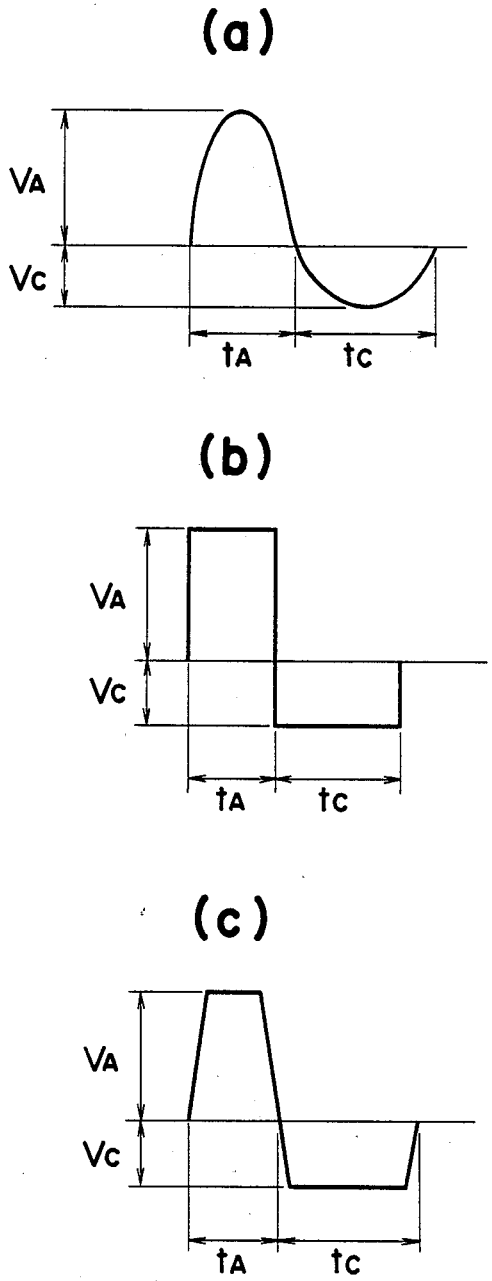
FIGS. 1 (*a*), (*b*) and (*c*) show the voltage waveform of the alternating wave currents usable in the electrolytic surface-roughening treatment of the present invention.

Now, the detailed description will be made on the present invention.

The aluminum plate usable in the present invention includes an aluminum plate and an aluminum alloy plate. The aluminum alloy plate includes various ones such as plates of alloys of aluminum with a metal, e.g. Fe, Si, Cu, Mn, Mg, Cr, Zn, Ti, Pb or Ni. For example, plates of commercially available aluminum JIS-A-1050, 1100 or 3003 are usable.

In conducting the present process, the aluminum plate is preferably cleaned in order to remove oil, grease, rust and dust from its surface. The plate is cleaned by, for example, degreasing with a solvent such as trichloroethylene or alkali etching-degreasing with sodium hydroxide, or the like. When the alkali etching-degreasing is conducted by using, for example, sodium hydroxide, smut is formed and, therefore, a desmutting which comprises, for example, immersing the plate in a 10 to 30% nitric acid solution, is usually conducted for removing it.

The thus cleaned aluminum plate is treated in order to form, on its surface, a thin layer resistant to the electrolytic surface-roughening treatment. The thin layer comprises a substance having a relatively high electrical insulation property. Namely, it may be an organic film such as an oil or grease film, a colloid film or an LB film (viz., Langmuir-Blodgett's layer), or an inorganic film such as an oxide film or a chemically formed film.

Having investigated various films, the inventors have found out that deep pits can be formed by forming an organic or inorganic film prior to the electrolytic surface-roughening treatment.

The thickness of the film is preferably 0.001 to 0.1 $g/m^2$ When it is less than 0.001 $g/m^2$, the effect of forming the deep pits is reduced. On the contrary, when it is thicker than 0.1 $g/m^2$, the diameter of the pits is too much large and the surface becomes rough.

Preferred inorganic films are oxide films having a thickness of 0.001 $g/m^2$ to 0.1 $g/m^2$ formed by treating the plate in an acidic electrolytic solution such as those of sulfuric acid, phosphoric acid, chromic acid, boric acid, nitric acid, sulfosalicylic acid and oxalic acid, using the current density of 0.01 to 50 $A/dm^2$ and the quantity of electricity of 0.5 to 10 $C/dm^2$. The process for forming the oxide coating includes the chemically formed film-forming process such as MBV process (a mixed solution of sodium carbonate with potassium bichromate is used), Alrok process, the phosphoric acid/alcohol process, Alodine process, Bonderite process and Bohmit process. It is preferable that a coating having a thickness of 0.01 to 0.1 g/m$^2$ is formed on the surface.

As another process, the aluminum surface may be exposed to a high temperature of 200 to a 500° C. to form a naturally oxidized film having a thickness of about 10 to 500 Å.

In all the cases, it is important to form the protective, electrically resistant film immediately before the surface-roughening treatment.

Any electrolytic solution usable in ordinary alternating current electrolytic etching can be used in the present electrolytic surface-roughening treatment. Particularly preferred are an aqueous solution containing 2 to 40 g/l of nitric acid, an aqueous solution containing 2 to 40 g/l of hydrochloric acid, and an aqueous solution containing 2 to 40 g/l each of them. As the concentration is reduced to less than 2 g/l, the efficiency of roughening the aluminum plate surface is reduced. On the contrary, as the concentration is increased to higher than 40 g/l, it is chemically corroded with the acid to make impossible the uniform roughening of the surface. The surface-roughening temperature ranges from ambient temperature to 70° C., preferably from ambient temperature to 50° C. A corrosion inhibitor such as a carboxylic acid, amine or aldehyde may be added to the electrolytic solution.

The electric current usable for the electrolytic surface-roughening treatment may be commercial alternating current or alternating wave current such as (*a*) sinusoidal wave current, (*b*) square wave current, or (*c*) trapezoidal wave current. The current density is preferably in the range of 10 to 200 A/dm$^2$. When it is lower than 10 A/dm$^2$, the pit formation is quite difficult and when it exceeds 200 A/dm$^2$, the control of uniform pit formation is difficult.

The present process can be conducted either batchwise or continuously. For example, in the continuous treatment, a resistant film-forming treatment vessel, a washing-with-water vessel and an electrolytic surface-roughening treatment vessel are arranged in this order, and an aluminum web is continuously passed therein to conduct the treatment.

It is preferable that the aluminum plate having the thus electrolytically roughened surface is chemically cleaned in order to remove the residue, i.e. smut, from the surface. The cleaning treatment is described in detail in U.S. Pat. No.3,834,998 and J. P. KOKOKU No.56-11316.

The aluminum plate thus treated and to be used as a lithographic support may be subjected to anodic oxidation to form an oxide film on its surface in order to improve its water retention, its adhesion to the photosensitive layer, and its mechanical strength of the surface of a non-image area. The anodic oxidation can be conducted by a known method. For example, it is conducted by using as the electrolytic solution, an aqueous solution of sulfuric acid, phosphoric acid, oxalic acid, amidosulfonic acid, sulfosalicylic acid, or a mixture thereof, or a solution wherein $A13^3$ + ion is further added thereto, and using, as an electric current, mainly a direct current. As an electric current, an alternating current or a combination of a direct current with an alternating current may also be used. The electrolyte concentration is preferably 1 to 80%, the temperature preferably 5 to 70° C., the current density preferably 0.5 to 60 A/dm$^2$, and the weight of the oxide film preferably 0.3 to 5 g/m$^2$.

After the anodic oxidation, the aluminum plate may be further immersed in an aqueous solution of a metal silicate such as sodium silicate as described in U.S. Pat. Nos.2,714,066 and 3,181,461; a hydrophilic cellulose (such as carboxymethylcellulose) containing a water-soluble metal salt (such as zinc acetate) may be applied to the aluminum plate to form an undercoat as described in U.S. Pat. No.3,860,426; or the aluminum plate may be treated with polyvinylphosphonic acid as described in U.S. Patent No.4,153,461.

A known photosensitive layer having been used for PS plate (pre-sensitized plate) can be formed on the thus prepared lithographic support to give a photosensitive lithographic plate, which is then subjected to a plate-making treatment to give a lithographic plate having a good performance.

The above-described photosensitive layer comprises, for example, the following composition:

(1) Photosensitive layer comprising a diazo resin and a binder:

As a negative-working light-sensitive diazo compounds, the condensation product (the so-called light-sensitive diazo resin) from a diphenylamine-p-diazonium salt and formaldehyde is preferably used, which is typical of the condensation product from a diazonium salt and an organic condensing reactant having a reactive carbonyl group such as an aldol or acetal, as disclosed in U.S. Pat. Nos. 2,063,631 and 2,667,415. Additional useful condensed diazo compounds are disclosed in U.S. Pat. No. 3,679,419 and British Patents 1,312,925 and 1,312,926. Light-sensitive diazo compounds of these types are generally obtained in the form of water-soluble inorganic salts and accordingly can be applied in the form of aqueous solutions. It is also possible to react these water-soluble diazo compounds with an aromatic or aliphatic compound having at least one phenolic hydroxyl group or sulfo group or both, as disclosed in British Patent 1,280,885, for instance, and use the resulting substantially water-insoluble light-sensitive diazo resins.

In addition, these diazo compounds can be used in the form of their reaction products with a hexafluorophosphate or tetrafluoroborate, as described in J. P. KOKAI No.56-121031.

The compound having a phenolic hydroxyl group includes, for example, hydroxybenzophenones and diphenolic acids such as 4,4-bis(4'-hydroxyphenyl)pentanoic acid, resorcinol and diresorcinol. They may have a substituent. The hydroxybenzophenones include 2,4-dihydroxybenzophenone, 2-hydroxy-4-methoxybenzophenone, 2,2'-dihydroxy-4,4'-dimethoxybenzophenone and 2,2',4,4'-tetrahydroxybenzophenone. The preferred components having a sulfonic acid group include aromatic sulfonic acids such as benzene-, toluene-, xylene-naphthalene-, phenol-, naphthol- and benzophenonesulfonic acids, and their soluble salts such as their ammonium and alkali metal salts. The compounds having a sulfonic acid group may be usually substituted with a lower alkyl group, a nitro group, a halo group and/or another sulfonic acid group. Preferred examples of these compounds include benzenesulfonic acid, toluenesulfonic acid, naphthalenesulfonic acid, 2,5-dimethylbenzenesulfonic acid, sodium benzenesulfonate, naphthalene-2-sulfonic acid, 1-naphthol-2(or 4)-sulfonic acid, 2,4-dinitro-1-naphthol-7-sulfonic acid, 2-hydroxy-4-methoxybenzophenone-5-sulfonic acid, sodium m-(p'-anilinophenylazo)benzenesulfonate, alizarinsulfonic acid, o-toluidine-m-sulfonic acid and ethanesulfonic acid. Sulfates of alcohols or aromatic hydroxy compounds and their salts are also usable. These compounds are easily available as anionic surfactants. They include, for example, ammonium and alkali metal salts of lauryl sulfates, alkylaryl sulfates, p-nonylphenyl sulfate, 2-phenylethyl sulfate and isooctylphenoxydiethoxyethyl sulfate.

These substantially water-insoluble photosensitve diazo resins can be isolated in the form of precipitate by mixing the water-soluble photosensitive diazo resin with an aqueous solution of the above-described aromatic or aliphatic compound, preferably in almost equal amounts.

In addition, the diazo resins described in British Patent No.1,312,925 are also preferred.

The amount of the diazo resin is preferably 5 to 50 wt. % based on the photosensitive layer. When the amount of the diazo resin is reduced, the photosensitivity is increased as a matter of course, but the storability is reduced. The optimum amount of the diazo resin is about 8 to 20 wt. %.

Although various polymer compounds are usable as the binder, those having a group such as a hydroxy, an amino, a carboxylic acid, an amido, a sulfonamido, an active methylene, a thioalcohol or an epoxy group are preferred. Such preferred binders include, for example, the shellac described in British Patent No.1,350,521; the polymers comprising a hydroxyethyl acrylate unit or a hydroxyethyl methacrylate unit as the main recurring unit, as described in British Patent No.1,460,978 and U.S. Pat. No.4,123,276; the polyamide resins as described in U.S. Pat. No.3,751,257; the phenolic resin and polyvinyl acetal resins such as polyvinyl formal resin and polyvinyl buryral resin, as described in British Patent No.1,074,392; and linear polyurethane resin, phthalated polyvinyl alcohol resin, epoxy resin which is a condensation product of bisphenol A and epichlorohydrin, polymers having an amino group such as polyaminostyrene and polyalkylamino (meth)acrylate, and cellulose derivatives such as cellulose acetate, cellulose alkyl ethers and cellulose acetate phthalate, as described in U.S. Pat. No.3,660,097.

The composition comprising the diazo resin and the binder may further contain additives such as the pH indicator as described in British Patent No. 1,041,463 and phosphoric acid and the dyes as described in U.S. Pat. No. 3,236,646.

(2) Photosensitive layer comprising an o-quinone diazide compound:

Particularly preferred o-quinone diazide compounds are those o-naphthoquinone diazide compounds as described in numerous publications such as U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709 and 3,647,443. They are suitably used in the present invention. Among them, o-naphthoquinone diazidosulfonic acid esters or o-naphthoquinone diazidocarboxylic acid esters of aromatic hydroxy compounds; and o-naphthoquinone diazidosulfonic acid amides or o-naphthoquinone diazidocarboxylic acid amides of aromatic amino compounds are preferred. Particularly preferred are the esterification reaction product of o-naphthoquinone diazidosulfonic acid with a condensate of pyrogallol with acetone, as described in U.S. Pat. No.3,635,709; the esterification reaction product of a polyester having a terminal hydroxy group with o-naphthoquinone diazidosulfonic acid or o-naphthoquinone diazidocarboxylic acid, as described in U.S Pat. No.4,028,111; the esterification reaction product of p-hydroxystyrene homopolymer or a copolymer thereof with another monomer copolymerizable therewith with o-naphthoquinone diazidosulfonic acid or o-naphthoquinone diazidocarboxylic acid, as described in British Patent No.1,494,043; and the amidation reaction product of a copolymer of p-aminostyrene with another copolymerizable monomer with o-naphthoquinone diazidosulfonic acid or o-naphthoquinone diazidocarboxylic acid as described in U.S. Pat. No.3,759,711.

Although these o-quinonediazido compounds can be used alone, it is desirable to mix them with an alkali-soluble resin. Preferred alkali-soluble resins include, for example, novolak-type phenolic resins such as phenol formaldehyde resin, o-cresol formaldehyde resin and m-cresol formaldehyde resin. It is further desirable to use the phenolic resin in combination with a condensate of phenol or cresol substituted with an alkyl group having 3 to 8 carbon atoms such as t-butylphenol formaldehyde resin with formaldehyde, as described in U.S. Pat. No.4,123,279. The amount of the alkali-soluble resin is about 50 to 85 wt. %, preferably 60 to 80 wt. %, based on the whole composition constituting the photosensitive layer.

The photosensitive composition comprising the o-quinone diazide compound may contain, if necessary, a dye, a plasticizer, and the components having a printing-out effect as described in, for example, British Patent Nos.1,401,463 and 1,039,475 and U.S. Pat. No.3,969,118.

(3) Photosensitive layer comprising an azido compound and a binder (polymer compound):

The compositions constituting this layer include, for example, the composition comprising an azide compound and a water-soluble or alkali-soluble polymer compound, as described in British Patent Nos.1,235,281 and 1,495,861 and J. P. KOKAI Nos.51-32331 and 51-36128; and the composition comprising a polymer having an azido group and a polymer compound as a binder, as described in J. P. KOKAI Nos.50-5102, 50-84302, 50-84303 and 53-12984.

(4) Other photosensitive resin layers:

They include, for example, the polyester compounds described in J. P. KOKAI No.52-96696, the polyvinyl cinnamate resins described in British Patent Nos. 1,112,277, 1,313,390, 1,341,004 and 1,377,747, and the photo-polymerizable photopolymer compositions described in, for example, U.S. Pat. Nos. 4,072,528 and 4,072,527.

The amount of the photosensitive layer formed on the support is in the range of about 0.1 to 7 $g/m^2$, preferably 0.5 to 4 $g/m^2$.

Having been imagewise exposed, the PS plate is subjected to ordinary treatments including the developing treatment to form a resin image. For example, the PS plate having the above-described photosensitive layer (1) comprising the diazo resin and the binder is imagewise exposed and then developed to remove the photosensitive layer in a non-exposed area with the developer as described in U.S. Pat. No. 4,186,006, so as to form a lithographic plate. The PS plate having the photosensitive layer (2) is imagewise exposed and then developed with the aqueous alkali solution as described in U.S. Pat. No.4,259,434 to remove the exposed area, thus forming the lithographic plate.

[EXAMPLES]

The following examples will further illustrate the present invention, which by no means limit the scope of the present invention. Unless otherwise stated, percentages are given by weight.

Example 1

An aluminum plate having a thickness of 0.24 mm was immersed in a 10% aqueous sodium hydroxide solution at 50° C. for 20 sec. to degrease/clean it. The plate was then washed with water and neutralized and washed with a 10% aqueous nitric acid solution. After washing with water, the plate was subjected to anodic oxidation in a 15% aqueous sulfuric acid solution with direct current (1 A/dm$^2$, 4 C/dm$^2$) at room temperature to give a thin film, which was then washed with water.

Thereafter the plate was electrolytically surface-roughened with a 9g/l aqueous nitric acid solution and the alternating wave current shown in FIG. 1 (*b*). The frequency was 60 Hz, the current density 40 A/dm$^2$, and the time 10 sec. Then, the smut formed in the electrolytic surface-roughening was removed by dissolving it by immersing the plate in a 20% aqueous sulfuric acid solution at 60° C. for 1 min.

The aluminum plate was subjected to the anodic oxidation with direct current (3 A/dm$^2$) in a 15% aqueous sulfuric acid solution so that the weight of the anodic oxidation film would be 2 g/m$^2$ After washing with water, the plate was immersed in a 3% aqueous sodium silicate solution, washed with water, and dried.

A photosensitive solution having the following composition was applied to the support thus prepared, and then dried, to give a photosensitive layer. The dry weight of the photosensitive layer thus formed was 2.0 g/m$^2$.

Photosensitive solution

N-(4-hydroxyphenyl)methacrylamide/2-hydroxyethyl methacrylate/ acrylonitrile/methyl methacrylate/ methacrylic acid (molar ratio: 15:10:30:38:7) (average molecular weight: 60,000):5.0 g Hexafluorophosphate of condensate of 4-diazodiphenylamine and formaldehyde:0.5 g Phosphorous acid:0.05 g Victoria Pure Blue BOH (a product of Hodogaya Kagaku Co., Ltd.):0.1 g 2-Methoxyethanol:100 g The thus prepared photosensitive lithographic plate was exposed to light of a metal halide lamp through a negative image film, then developed with a standard developer DN-3C for negative-working PS plates (a product of Fuji Photo Film Co., Ltd.), and finally rubberized, to give the lithographic plate. It was used for printing to produce 100,000 sheets of excellent prints. The non-image area was not stained.

Comparative Example 1

The same procedure as that of Example 1 was repeated except that no thin anodic oxidation film was formed after the degreasing/cleaning followed by the neutralization/washing and before the electolytic surface-roughening. The printing durability of the thus obtained lithographic plate was 60,000 sheets. The non-image area was more easily stained than that of Example 1.

Example 2

The same procedure as that of Example 1 was repeated except that the thin film was formed by the anodic oxidation in a 9 g/l aqueous nitric acid solution using 0.1 A/dm$^2$ and 6 C/dm$^2$. The printing durability was 100,000 sheets. The non-image area was not stained.

Example 3

The same procedure as that of Example 1 was repeated except that the aluminum plate was immersed in a 2.5% Alodine #301 N-1 sold by Nippon Paint Co., Ltd. at 35° C. for 60 sec. The printing durability was 100,000 sheets. The non-image area was not stained.

Example 4

The same procedure as that of Example 1 was repeated except that 20 mg/m$^2$ of oil was applied to the aluminum plate to form a thin film after the degreasing/cleaning, and except that the oil remaining on the aluminum plate surface was removed with a detergent after the electrolytic surface-roughening. The printing durability was 100,000 sheets. The non-image area was not stained. Example 5

The same procedure as that of Example 1 was repeated except that the electrolytic surface-roughening was conducted in an electrolytic solution containing 5 g/l of hydrochloric acid with the alternating wave current shown in FIG. 1 (*b*) for 20 sec. The frequency and current density were 60 Hz and 30 A/dm$^2$, respectively. The printing durability was 100,000 sheets. The non-image area was not stained.

Comparative Example 2

The same procedure as that of Example 5 was repeated except that the anodic oxidation was not conducted before the electrolytic surface-roughening and that the electrolytic surface-roughening was conducted with hydrochloric acid as an electrolytic solution. The printing durability was 60,000 sheets. The non-image area was more easily stained than that of Example 5.

In the above-described Examples, the combination of the negative-working photosensitive layer with the support surface-roughened by the present process was employed. Further, the similar effects as above could be obtained when a combination of a positive-working photosensitive layer with the same support as above was employed.

The lithographic plate comprising the surface-roughened aluminum support according to the present invention had an excellent printing durability and capable of forming the prints in which the non-image area was not stained.

What is claimed is:

1. A process for electrolytically surface-roughening an aluminum plate in an acidic electrolytic solution, comprising forming an organic coating comprised of a compound having a relatively high electrical insulation or inorganic coating on said aluminum plate prior to the electrolytic surface-roughening.

2. The process of claim 1, wherein said organic coating is selected from the group consisting of an oil film, a grease film, a colloid film and an LB film.

3. The process of claim 1 wherein said inorganic coating is an oxide film or a chemically formed film.

4. The process of claim 3 wherein said chemically formed film is produced by MBV process, Alrok process, the phosphoric acid/alcohol process, Bonderite process or Alodine process.

5. The process of claim 1 wherein said organic or inorganic coating has a thickness of 0.001 $g/m^2$ to 0.1 $g/m^2$.

6. The process of claim 1, comprising further anodizing said aluminum plate after the electrolytic surface roughening.

7. A process for electrolytically surface-roughening on aluminum plate in an acidic electrolytic solution comprising forming an organic or inorganic coating on said aluminum plate prior to the electrolytic surface-roughening, wherein said acidic electrolytic solution comprises an aqueous solution containing hydrochloric acid, nitric acid or a mixture thereof.

8. The process of claim 7, wherein the aluminum plate is electrolytically surface-roughened with an alternating current.

9. The process of claim 8, wherein the alternating current has a current density in a range of from 10 to 200 $A/dm^2$.

* * * * *